US005971569A

United States Patent [19]

Smith et al.

[11] Patent Number: 5,971,569

[45] Date of Patent: Oct. 26, 1999

[54] SURGICAL LIGHT WITH STACKED ELLIPTICAL REFLECTOR

[75] Inventors: A. Michael Smith, Boulder; Henry Holt Frazier, Broomfield, both of Colo.

[73] Assignee: Steris Corporation, Mentor, Ohio

[21] Appl. No.: 08/872,890

[22] Filed: Jun. 11, 1997

[51] Int. Cl.[6] ..... F21V 7/08; F21V 9/04

[52] U.S. Cl. ..... 362/304; 362/33; 362/293; 362/350; 362/804

[58] Field of Search ..... 362/33, 293, 304, 362/305, 348, 350, 804

[56] References Cited

U.S. PATENT DOCUMENTS

| | | | |
|---|---|---|---|
| 2,088,024 | 7/1937 | Baber | 362/33 |
| 3,337,871 | 8/1967 | Greenberg et al. | 342/5 |
| 3,449,561 | 6/1969 | Basil et al. | 362/350 |
| 3,644,730 | 2/1972 | Ogle, Jr. et al. | 362/345 |
| 3,679,893 | 7/1972 | Shemitz et al. | 362/345 |
| 4,159,511 | 6/1979 | Dejonc | 362/299 |
| 4,234,247 | 11/1980 | Dorman | 362/297 |
| 4,242,727 | 12/1980 | de Vos et al. | 362/346 |
| 4,254,455 | 3/1981 | Neal, Jr. | 362/296 |
| 4,417,300 | 11/1983 | Bodmer | 362/304 |
| 4,422,134 | 12/1983 | Brass | 362/300 |
| 4,575,788 | 3/1986 | Lewin | 362/346 |
| 4,578,575 | 3/1986 | Roos | 250/203.1 |
| 4,617,619 | 10/1986 | Gehly | 362/302 |
| 4,683,525 | 7/1987 | Camm | 362/346 |
| 4,686,612 | 8/1987 | Pringle et al. | 362/297 |
| 4,750,097 | 6/1988 | Pringle et al. | 362/297 |
| 4,755,918 | 7/1988 | Pristash et al. | 362/301 |
| 4,794,503 | 12/1988 | Wooten et al. | 362/348 |
| 4,945,455 | 7/1990 | Akizuki | 362/348 |
| 4,979,086 | 12/1990 | Heinisch | 362/297 |
| 5,169,229 | 12/1992 | Hoppert et al. | 362/293 |
| 5,199,785 | 4/1993 | Scholz | 362/296 |
| 5,331,530 | 7/1994 | Scholz | 362/293 |

FOREIGN PATENT DOCUMENTS

| | | | |
|---|---|---|---|
| 512192 | 1/1921 | France | 362/804 |
| 825638 | 12/1959 | United Kingdom | 362/804 |

*Primary Examiner*—Alan Cariaso
*Attorney, Agent, or Firm*—Fay, Sharpe, Beall, Fagan, Minnich & McKee, LLP

[57] ABSTRACT

A surgical lighthead having a stacked elliptical reflector (20) directs light from a lamp (10) to an illumination zone (Y) without the need for a refractor to redirect the reflected light. The reflector is formed of at least three annular reflector segments (22, 24, 26) stacked on top of each other to form a continuous reflector surface. Each of the reflector segments has a longitudinal cross section of a different conical shape such as elliptical or parabolic for directing the light to a different portion of the illumination plane. The stacked elliptical reflector provides the benefits of reduction of the image of the filament in the light field and reduction of shadowing due to objects passing between the lighthead and the illumination plane.

18 Claims, 1 Drawing Sheet

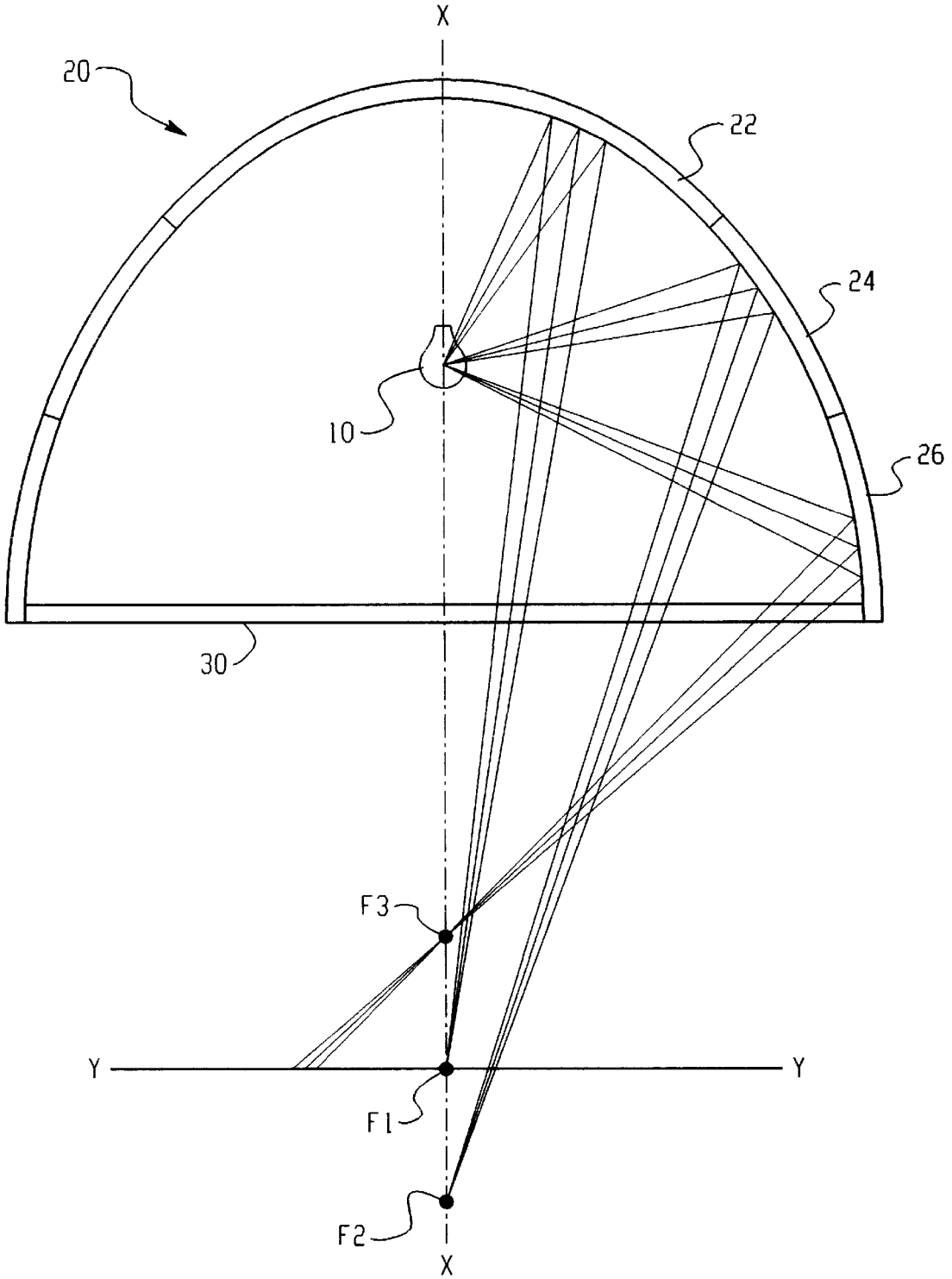
X
20
22
24
10
26
30
F3
Y
Y
F1
F2
X

SURGICAL LIGHT WITH STACKED ELLIPTICAL REFLECTOR

BACKGROUND OF THE INVENTION

The present invention relates to the field of lighting. It finds particular application to surgical lights and will be described with particular reference thereto. It is to be appreciated, however, that the present invention may also find application in conjunction with other types of non-surgical lighting systems.

Surgical lights used to illuminate surgical sites generally include one or more lamps disposed inside the dome of a dome-shaped reflector which directs light from the lamp to the area to be illuminated. Surgical lights are generally suspended above an operating table by one or more adjustable, articulated arms so that the lamp can be positioned as necessary during surgery.

Typically, surgical lights employ a lamp such as a tungsten halogen lamp which is positioned at or near the focal point of the dome-shaped reflector. The light from the lamp is reflected downward by the reflector through an optical lens or refractor positioned at a lower surface of the light fixture. The refractor is particularly designed to coordinate with the reflector to direct the light in a defined column or cone to an illumination zone. A typical refractor for a surgical lighthead includes up to many thousands of prisms each having a specific prescription in order to direct the light from the reflector to the illumination zone.

In order to prevent shadows when the surgeon's hand or head passes between the lamp and the patient, the reflector is generally quite large and focuses the light at an illumination zone which is the same size or smaller than the refractor. The refractor functions as a diffuser to diffuse the light which helps to prevent shadows. The diffuse light also helps to prevent the image of the filament from appearing prominently in the illumination zone. The size of the illumination zone in most surgical lights can be adjusted by a rotatable sterile handle provided at the center of the face of the light head.

A typical tungsten halogen lamp used in surgical lights includes a tungsten filament that emits energy when electric current passes through the filament. These lamps emit visible light and also emit ultraviolet, infrared, and other undesirable energy. In fact, about 81 percent of the input power to a lamp of this type is converted to infrared energy. However, if this infrared energy is directed to a surgical site, heating of the surgical site will occur which may cause tissue damage. Removal or filtering of the infrared energy from the light directed to the surgical cite to prevent tissue damage may be accomplished by one or more different devices including heat absorbing glasses, cold mirror coatings, and hot mirror coatings. Hot and cold mirror coatings are called dichroic coatings and transmit energy of some wavelengths while reflecting energy of other wavelengths.

The reflectors and refractors which are used in many known types of surgical lights are large precision devices formed of glass which is coated with a dichroic coating material. One of the drawbacks of the known surgical lightheads is that the reflectors and refractors, due to the use of glass and their large size, are extremely heavy and are expensive to manufacture. The refractor is particularly expensive because of the thousands of individual prescription prisms, generally constituting about 12% of the cost of the lighthead.

It is important that the light field or illumination zone created by a surgical light, when focused on a planar surface, have a consistent uniform intensity at all diameters of the zone when viewed by the human eye. However, if the light zone has a completely uniform intensity, the human eye will perceive the edges of the light zone as having a higher intensity than the center. Thus, the light intensity should be manipulated to have a desired intensity profile which will appear constant and uniform to the human eye.

In addition, the human eye is most sensitive to light in approximately the center or the green portion of the visible light spectrum. Thus, a light which has more green and less of the other visible light colors is most desirable for surgical lighting applications. However, one of the drawbacks of known surgical lights is that typical lamps, such as tungsten halogen lamps, used in these surgical lightheads do not have a desirable visible light color distribution.

The present invention contemplates a new and improved surgical lighthead and technique for overcoming the above-referenced drawbacks and others.

SUMMARY OF THE INVENTION

The present invention relates to a surgical lighthead having a stacked elliptical reflector formed of a series of elliptically shaped segments for directing light from a lamp to provide illumination of a surgical site without the need for a refractor to redirect the reflected light.

In accordance with one aspect of the present invention, a surgical lighthead includes a lamp, a reflector positioned about the lamp with the lamp along a longitudinal axis of the reflector, the reflector directing light from the lamp to a plane of illumination for illumination of a surgical site, the reflector formed of at least three annular reflector segments stacked on top of each other to form a continuous reflector surface, each of the annular reflector segments having a longitudinal cross section of a different conical shape for directing the light from the lamp to a portion of the plane of illumination, the lamp located adjacent a focal point of each of the conical shaped reflector segments, and a transparent shield enclosing an aperture of the reflector and transmitting undeflected light from the reflector to the light field.

In accordance with a more limited aspect of the present invention, each of the reflector segments directs light to a different annular portion of the plane of illumination.

In accordance with another more limited aspect of the invention, the reflector segments are elliptically shaped, a second focal point of a first of the elliptical shaped lamp segments is located above the plane of illumination and a second focal point of a second of the elliptical shaped lamp segments is located below the plane of illumination.

In accordance with a further aspect of the invention, a second focal point of a third of the elliptical shaped lamp segments is located approximately in the plane of illumination.

The benefits of the present invention include the ability to economically direct light from a lamp to a surgical site and eliminate the need for a precision refractor to direct the light.

The present invention also provides the benefits of reducing or preventing an image of the filament from appearing in the illumination plane and reducing the shadows caused by objects passing between the lighthead and the illumination plane.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawing is only for purposes of illustrating a preferred embodiment and is not to be construed as limiting the invention.

FIG. 1 is a schematic side sectional view of a surgical lamp with a stacked elliptical reflector according to the present invention.

DETAILED DESCRIPTION OF THE PREFERRED EMBODIMENT

With reference to FIG. 1, the surgical lighthead according to one embodiment includes a lamp 10, a multi-segmented reflector 20 for directing the light from the lamp to a surgical site, and a transparent light shield 30. The reflector 20 gathers the raw flux emitted by the lamp and redirects it through the lighthead aperture to form a light field in a single step. Unlike most surgical lighthead designs, in the present invention, there is no need for a separate refractor to redirect the light from the reflector to the light field because the reflector itself adequately focuses the light. While no refractor is needed, the transparent shield 30 is provided over the lighthead aperture to seal the aperture providing a completely enclosed lighthead.

The multi-segmented reflector 20 illustrated in FIG. 1 includes three annular reflector segments 22, 24, 26. The interior surfaces of each of these annular reflector segments is rotationally symmetrical about the longitudinal axis X of the lighthead. The longitudinal cross sections of each of the three reflector segments 22, 24, 26 have interior surfaces formed in the shape of an ellipse. Although the shapes of the three reflector segments are illustrated in FIG. 1 as ellipses, they may also be in the form of other conic shapes such as parabolic. The reflector segments 22, 24, 26 are each designed to illuminate a particular region of the light field.

In the lighthead of FIG. 1, the upper reflector segment 22 is formed from an ellipse having a first focus point at the location of the lamp 10 and a second focus point Fl which is generally coincident with an illumination plane Y. The upper reflector segment 22 illuminates the central region of the light field surrounding the longitudinal axis X. The intermediate reflector segment 24 is formed from a segment of an ellipse having a first focus point at the location of the lamp 10 and a second focus point at the point F2. The focus point F2 is located below the illumination plane Y. Thus, the light reflected by the intermediate reflector segment 24 intersects the illumination plane in a generally ring shaped intermediate region surrounding the central region.

Finally, the lower reflector segment 26 has a first focus point at the location of the lamp 10 and a second focus point at a location F3 above the illumination plane Y. The light reflected by the lower reflector segment 26 illuminates a ring shaped area of the illumination plane which is radially outside of the intermediate region illuminated by the intermediate reflector segment 24.

Preferably, the lamp 10 is movable along the X-axis to adjust the focus. Moving the lamp downward from the focal spot diffuses the ray pattern from all three reflector segments enlarging the diameter of the light beam at the illumination plane Y.

The illumination of different portions of the illumination plane Y with different elliptical shaped segments of the reflector provides an illumination field with a less prominent image of the lamp filament because the lamp filament is not reflected at a single location within the illumination field. In addition, the illumination field will experience less shadowing when the surgeon's head or hand pass between the light and the illumination plane due to the relatively diffuse light generated by the three elliptical reflector segments 22, 24, 26.

The present invention has been described as including three reflector segments 22, 24, 26, focused at, above, and below the illumination plane. In theory, an infinite number of reflector segments could be stacked to form a segmented reflector providing very precise and accurate control over the illumination of the light field. However, the manufacturing tolerance of such a reflector is expensive. Therefore, a more practical reflector which provides acceptable control of the illumination field at acceptable tolerances includes between 3 and 20 reflector segments. As the number of reflector segments increases, the ability to precisely control the illumination of the light field also increases due to the ability to individually focus and manipulate each of the reflector segments. With a lower number of reflector segments lower quality illuminance patterns will result, and most likely inconsistent patterns throughout the depth of the light field. With larger numbers of reflectors, the reflectors can be stacked with their second focal spot above and below the illumination plane.

Even with as few as three elliptical reflector segments the light field can be controlled to establish a desirable illuminance pattern having a reduced intensity at the edges of the light field which appears to the human eye to have a consistent intensity throughout. This type of modified light intensity pattern can be more accurately controlled with additional reflector segments. The reflector segments need not all be of the same size. Making the segment which focus on the outer periphery of the target smaller, reduces the amount of light sent to that zone. The intensity in a given zone can also be reduced by configuring the corresponding reflector segment with its upper focal point offset from the lamp to spread its contributed rays.

The individual reflector segments 22, 24, 26 according to a preferred embodiment are formed of a plastic substrate coated with a reflective coating. The segments are also preferably coated with a thin film coating which provides color correction and a cold mirror coating which removes harmful infrared energy. A cold mirror coating permits infrared energy to be transmitted through the coating while the visible energy is reflected. According to one embodiment, hot mirror coatings are provided on the transparent light shield 30 for additional removal of infrared energy. Hot mirror coatings reflect infrared energy while allowing visible light to pass.

It is noted that the reflector configuration shown in FIG. 1 is a schematic illustration of the surgical lighthead and does not illustrate the actual proportions of the preferred embodiments of the lighthead. The illustrated embodiment includes three reflectors which in a stacked configuration form a domed shape with smoothed intersegment transition zones. However, a reflector having more abrupt transitions between stacked reflector segments is also within the scope of the invention.

According to an alternative embodiment of the invention, the reflector segments 22, 24, 26 are formed with a parabolic cross section. With the parabolic reflector segments, the lamp is positioned just below a focal point of each of the parabolas causing the light to converge in a criss-crossing pattern of illumination which can be focused by moving the lamp up or down along a longitudinal axis of the reflector. Each of the parabolic reflector segments is arranged to provide illumination of a different zone within the illumination field.

The lighthead having a stacked elliptical or parabolic reflector according to the present invention has the advantage of eliminating the need for an expensive prescription refractor to direct the light properly to the light field. The elimination of the refractor greatly reduce the overall cost of the lighthead.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents.

Having thus described the preferred embodiment, the invention is now claimed to be:

1. A surgical lighthead comprising:

a lamp;

a reflector positioned about the lamp with the lamp along a longitudinal axis of the reflector, the reflector directing light from the lamp to a plane of illumination for illuminating a surgical site, the reflector formed of at least three elliptically shaped annular reflector segments stacked on top of each other to form a continuous reflector surface, each of the annular reflector segments having a longitudinal cross section of a different elliptical shape for directing the light from the lamp to a different annular portion of the plane of illumination, the lamp being disposed adjacent a first focal point of each of the elliptically shaped reflector segments, a second focal point of a first of the elliptically shaped reflector segments being located above the plane of illumination, and a second focal point of a second of the elliptically shaped reflector segments being located below the plane of illumination; and, a transparent shield enclosing an aperture of the reflector and transmitting undeflected light from the reflector to said surgical site.

2. The surgical lighthead as set forth in claim 1 wherein each of the reflector segments are formed of a plastic substrate coated with a reflective coating.

3. The surgical lighthead as set forth in claim 1 wherein each of the reflector segments are formed of a plastic substrate coated with a thin film coating which performs color correction and removes infrared light from the reflected light.

4. The surgical lighthead as set forth in claim 1 wherein a second focal point of a third of the elliptically shaped reflector segments is located approximately in the plane of illumination.

5. The surgical lighthead as set forth in claim 4 wherein each of the elliptically shaped reflector segments illuminates a different region of the plane of illumination.

6. The surgical lighthead as set forth in claim 1 wherein the lamp is a tungsten halogen lamp.

7. A surgical lighthead including a lamp, a dome shaped reflector positioned about the lamp with the lamp along a longitudinal axis of the reflector, the reflector directing light from the lame to an illumination plane for illumination of a surgical site, the reflector being formed of at least three annular reflector segments stacked on top of each other to form a continuous reflector surface, each of the annular reflector segments having a longitudinal cross section of a different elliptical shape for directing the light from the lamp to a different annular portion of the illumination plane, the lamp being located at a first focal point of each of the elliptical shaped reflector segments, the lighthead including a prism-free transparent shield enclosing an aperture of the reflector and transmitting reflected light from the reflector unrefracted to the illumination plane, the improvement comprising:

a second focal point of a first of the elliptical shaped reflector segments is located above the illumination plane and a second focal point of a second of the elliptical shaped reflector segments is located below the illumination plane.

8. The surgical lighthead as set forth in claim 7 wherein a second focal point of a third of the elliptical shaped reflector segments is located approximately in the illumination plane.

9. The surgical lighthead as set forth in claim 8 wherein each of the elliptical shaped reflector segments illuminates a different region of the illumination plane.

10. The surgical lighthead as set forth in claim 7 wherein each of the reflector segments are formed of a plastic substrate coated with a thin film coating which performs color correction and removes infrared light from the reflected light.

11. The surgical lighthead as set forth in claim 7 wherein each of the reflector segments illuminates a different annular portion of said illumination plane.

12. The surgical lighthead as set forth in claim 7 wherein the lamp is a tungsten halogen lamp.

13. The surgical lighthead as set forth in claim 7 wherein each of the reflector segments are formed of a plastic substrate coated with a reflective coating.

14. A method of illuminating a surgical site comprising:

generating light with a lamp;

reflecting a first portion of the light from the lamp with a first reflector segment having a first elliptical shape with a first focal point adjacent the lamp toward a second focal point above an illumination plane;

reflecting a second portion of the light from the lamp with a second reflector segment having a second elliptical shape with a first focal point adjacent the lamp toward a second focal point approximately at the illumination plane; and, reflecting a third portion of the light from the lamp with a third reflector segment having a third elliptical shape with a first focal point adjacent the lamp toward a third focal point below the illumination plane, wherein the light reflected by the first, second, and third reflector segments passes unrefracted through a transparent shield.

15. The method according to claim 14 wherein the step of generating light with said lamp includes generating said light with a tungsten halogen lamp.

16. The method according to claim 14 wherein:

the step of reflecting said first portion of the light from the lamp with said first reflector segment includes providing said first reflector segment as a first plastic substrate coated with a reflective coating;

the step of reflecting said second portion of the light from the lamp with said second reflector segment includes providing said second reflector segment as a second plastic substrate coated with a reflective coating; and, the step of reflecting said third portion of the light from the lamp with said third reflector segment includes providing said third reflector segment as a third plastic substrate coated with a reflective coating.

17. The method according to claim 14 wherein:

the step of reflecting said first portion of the light from the lamp with said first reflector segment includes providing said first reflector segment as a first plastic substrate coated with a thin film coating which performs color correction and removes infrared light from the reflected light;

the step of reflecting said second portion of the light from the lamp with said second reflector segment includes providing said second reflector segment as a second plastic substrate coated with a thin film coating which performs color correction and removes infrared light from the reflected light; and, the step of reflecting said third portion of the light from the lamp with said third reflector segment includes providing said third reflector segment as a third plastic substrate coated with a thin film coating which performs color correction and removes infrared light from the reflected light.

18. The method according to claim 14 wherein the steps of reflecting said first, second, and third portions of the light from the lamp with said first, second, and third reflector segments includes reflecting said first, second, and third portions of the light onto different annular portions of said surgical site.

* * * * *